US006200048B1

(12) United States Patent
Bouix

(10) Patent No.: US 6,200,048 B1
(45) Date of Patent: Mar. 13, 2001

(54) STABLE PROPEL/REPEL MECHANISM

(75) Inventor: Herve F. Bouix, New York, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/256,858

(22) Filed: Feb. 24, 1999

(51) Int. Cl.[7] ..... A45D 40/06
(52) U.S. Cl. ..... 401/78; 401/77; 401/87
(58) Field of Search ..... 401/70, 71, 75, 401/77, 78, 87

(56) References Cited

U.S. PATENT DOCUMENTS

| | | | | |
|---|---|---|---|---|
| 2,444,376 | * | 6/1948 | Seaver | 401/87 |
| 2,469,631 | * | 5/1949 | Broder | 401/87 |
| 2,507,928 | * | 5/1950 | Onley, Jr. | 401/77 |
| 5,234,275 | | 8/1993 | Gueret . | |
| 5,560,727 | * | 10/1996 | Vaupel | 401/78 |
| 5,865,550 | | 2/1999 | Bouix . | |
| 5,873,379 | | 2/1999 | Bouix | 132/318 |
| 5,899,620 | * | 5/1999 | Pierpont | 401/78 |

FOREIGN PATENT DOCUMENTS

| | | | |
|---|---|---|---|
| 0 726 042 | 8/1996 | (EP) | A45D/40/16 |
| 934386 | 1/1948 | (FR) . | |
| 1008675 * | 5/1952 | (FR) | 401/78 |
| WO 92/12651 | 8/1992 | (WO) | A45D/40/60 |
| WO 93/16615 | 9/1993 | (WO) | A45D/40/06 |
| WO 93/32031 | 10/1996 | (WO) | A45D/40/06 |

* cited by examiner

*Primary Examiner*—Charles R. Eloshway
(74) *Attorney, Agent, or Firm*—Kenyon & Kenyon

(57) ABSTRACT

A case for a stick product which comprises an inner sleeve having a wall and two longitudinal tracks within the wall, each longitudinal track is positioned approximately circumferentially opposite with respect to the other. An outer sleeve is fitted about the inner sleeve so as to be able to rotate with respect to the inner sleeve. The outer sleeve has an inner wall, an outer wall, and four helical grooves along the inner wall. A holder cup for the stick product is fitted into the inner sleeve. The holder cup comprises a shell having an inner surface, an outer surface, a first set of lugs, and a second set of lugs, wherein one lug from each set extends through the same longitudinal track to engage one of the four helical grooves. By providing two set of lugs, as opposed to the traditional one set, skewing of the holder cup is dramatically reduced. When the holder cup travels along its axial path between the advanced and retracted positions, the torque experienced by the first set of lugs is equal and opposite to the torque experienced by the second set of lugs. The two opposing forces cancel each other and keep the holder cup steady during travel within the case, thus reducing the possibility of damaging the stick product.

19 Claims, 3 Drawing Sheets

STABLE PROPEL/REPEL MECHANISM

FIELD OF THE INVENTION

The present invention relates to a case for housing a stick product, especially lipstick, which case contains a holder cup for the stick product. More particularly, it relates to a case which allows the holder cup to be moved between an advanced position, where the product within the holder cup is capable of being applied by the consumer, and a retracted position, where a cover can be applied to the case so that the product can be stored without damage.

BACKGROUND OF THE INVENTION

In a typical lipstick case, in order to enable the holder cup to be moved between an advanced and a retracted position, the case is provided with an inner sleeve and an outer sleeve which rotate with respect to each other. The inner sleeve has a wall and a longitudinal track extending through the wall. The outer sleeve is placed about the inner sleeve so as to be able to rotate with respect to the inner sleeve. The outer sleeve has an inner wall, an outer wall, and a helical groove which extends along a substantial length of the inner wall. The holder cup is fitted into the inner sleeve. The holder cup is provided with at least one lug which extend through the longitudinal track of the inner sleeve to engage the helical groove of the outer sleeve. When the inner and outer sleeves are rotated, the lug of the holder cup follows the path defined by the longitudinal track and the helical groove, thereby moving the holder cup between an advanced and a retracted position.

In order to enable the holder cup to easily move between an advanced and a retracted position, the holder cup is typically provided with a pair of opposing lugs. Whether the holder cup has one lug, or a pair of opposing lugs, certain problems arise during its operation. Namely, the use of only one lug, or a pair of lugs, creates an instability of the cup. As the inner and outer sleeve of the case are rotated with respect to each other, a torque is applied to the lug(s) of the holder cup. This torque advances and retracts the cup, and also causes the cup to pivot about the axis of the lug(s), thus causing the cup to skew as it travels within the case.

In order for the case to function properly, the cup must be able to move between the advanced and retracted positions without undue interference or resistance. Therefore, a certain space, however small, is required between the holder cup and the inner sleeve, which space varies due to manufacturing tolerances of the individual components of the case itself. This space, and the variations in its size, is what enables the holder cup to pivot. Typically, the stick product is an elongated cylinder which is held within the holder cup at the base, thereby leaving the majority of the stick extending out of the holder cup. Because the lugs are placed on the holder cup, a slight pivot about the axis of the lugs will be exaggerated near the tip of the stick, and typically will be enough to cause the product within the holder cup to contact the inner surface of the inner sleeve, thereby deforming the product and interfering with the function of the case.

The purpose of the present invention is to provide a stick product case which will reduce the skew of the holder cup while continuing to provide simple operation of the case.

Another purpose of the present invention is to provide a stick product case that is simple to manufacture.

Further, it is a purpose of this invention to provide a stick product case which is a relatively simple item that avoids interference with package aesthetics.

SUMMARY OF THE INVENTION

The present invention is a case for a stick product which comprises an inner sleeve having a wall and two longitudinal tracks within the wall, each longitudinal track is positioned approximately circumferentially opposite with respect to the other. An outer sleeve is fitted about the inner sleeve so as to be able to rotate with respect to the inner sleeve. The outer sleeve has an inner wall, an outer wall, and four helical grooves along the inner wall. A holder cup for the stick product is fitted into the inner sleeve. The holder cup comprises a shell having an inner surface, an outer surface, a first set of lugs, and a second set of lugs, wherein one lug from each set extends through the same longitudinal track to engage one of the four helical grooves.

By providing two set of lugs, as opposed to the traditional one set, skewing of the holder cup is dramatically reduced. When the holder cup travels along its axial path between the advanced and retracted positions, the torque experienced by the first set of lugs is equal and opposite to the torque experienced by the second set of lugs. The two opposing forces cancel each other and keep the holder cup steady during travel within the case, thus reducing the possibility of damaging the stick product.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

For purposes of clarity, the present invention will be described as used in conjunction with a lipstick case. This example is merely illustrative, and in no way limits the present invention to lipstick. It will be apparent to one of ordinary skill in the art how the present disclosure can be adapted for use with any stick product, including, but not limited to, deodorants, lip balms, make-up foundations, clear cosmetic sticks, anti-acne sticks, concealers, sunscreen sticks, and the like.

Figure 1:
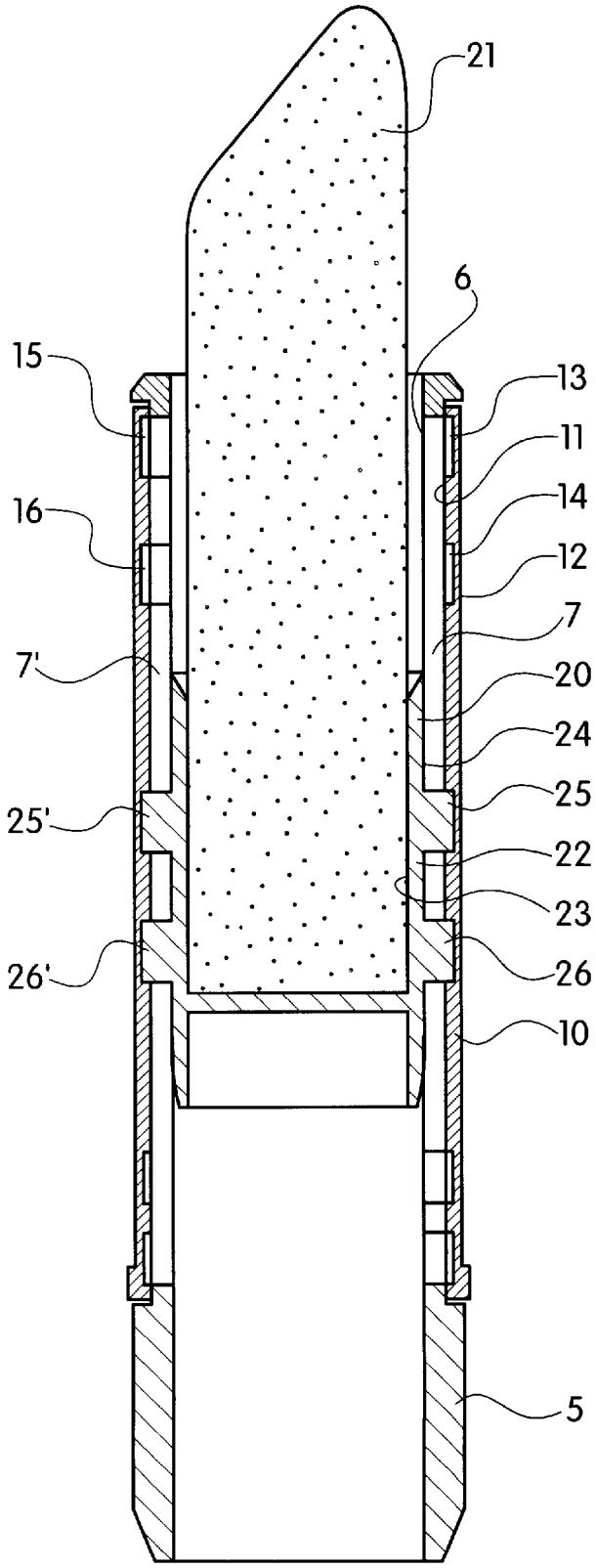
FIG. 1 is a cross-sectional view of one embodiment of the case of the present invention.

Referring now to the drawings, FIG. 1 shows one embodiment of the case of the present invention. The case comprises a hollow inner sleeve 5 having a wall 6 and two longitudinal tracks 7 and 7' within the wall 6. The longitudinal tracks 7 and 7' are positioned approximately circumferentially opposite with respect to each other. An outer sleeve 10 is fitted about the inner sleeve 5 so as to be able to rotate with respect to the inner sleeve 5. The outer sleeve 10 has an inner wall 11, an outer wall 12, and four helical grooves 13, 14, 15, 16 along the inner wall 11.

A holder cup 20 for the stick product 21 is fitted into the inner sleeve 5. The holder cup 20 comprises a shell 22 having an inner surface 23 and an outer surface 24. A first set of lugs 25 and 25' and a second set of lugs 26 and 26' extend from the outer surface 24 of the holder cup 20. When placed within the inner sleeve 5, lugs 25 and 26 extend through longitudinal track 7, and lugs 25' and 26' extend through longitudinal track 7'. Each lug 25, 25', 26, and 26' engages its respective helical groove 13, 14, 15, and 16 of the outer sleeve 10. Preferably, the lugs within each set 25, 25' and 26, 26' are positioned on the same horizontal plane perpendicular to the axis of the cup and spaced approximately 180 degrees circumferentially from the other lug within the set. Most preferably, the first and the second set of lugs are aligned vertically with respect to each other. In other words, as seen in FIG. 1 for example, the first set of lugs 25 and 25' are positioned on a first plane and aligned above the second set of lugs 26 and 26' which are positioned on a second plane.

By providing two set of lugs, as opposed to the traditional one set, skewing of the holder cup is dramatically reduced. When the holder cup travels along its axial path between the advanced and retracted positions, the torque experienced by the first set of lugs is equal and opposite to the torque experienced by the second set of lugs. The two opposing forces cancel each other and keep the holder cup steady during travel within the case, thus reducing the possibility of damaging the stick product through contact with the wall 6 of the inner sleeve 5.

Figure 2:
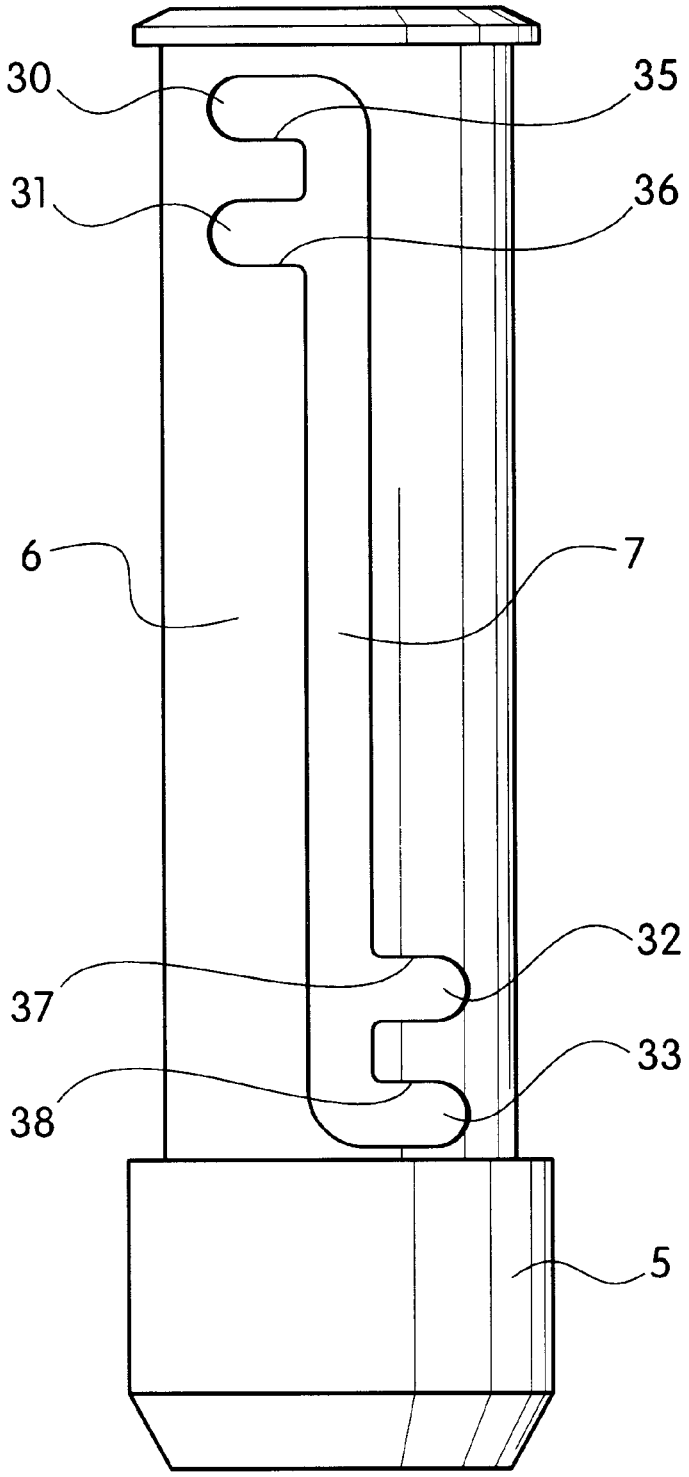
FIG. 2 is a plan view of the inner sleeve of the present invention.

As seen more clearly in FIG. 2, longitudinal track 7 is preferably provided with a first upper lateral segment 30, a second upper lateral segment 31, a first lower lateral segment 32, and a second lower lateral segment 33. Not shown in FIG. 2, but present, are the same upper and lower lateral segments for longitudinal track 7', the only difference being that the lateral segments of track 7' will be mirrored in relation to the lateral segments of track 7. The lateral segments of each track need to be mirrored in relation to each other so that the lugs of the holder cup can position themselves within the upper lateral segments when the holder cup is in the advanced position, and in the lower lateral segments when the holder cup is in the retracted position. If the lateral segments were not mirrored with respect to each other, then the lugs could not find their way into the lateral segments.

The upper lateral segments 30 and 31 retain the holder cup in the advanced position while the lipstick is being applied by the consumer by providing surfaces 35 and 36, respectively, upon which the lugs of the holder cup can rest. If surfaces 35 and 36 were not present, the force created during application of the product would cause the holder cup to travel down the longitudinal tracks and into the retracted position, thus making application difficult. Likewise, the lower lateral segments 32 and 33 provide surfaces 37 and 38 which serve to retain the holder cup 20 in the retracted position. If surfaces 37 and 38 were not present, a shock to the case while the holder cup was in the retracted position would cause the holder cup to travel along the longitudinal tracks, thus causing the stick product to contact the inner surface of the cover of the case (not shown), thereby deforming the application surface of the lipstick and possibly fracturing the lipstick itself.

Figure 4:
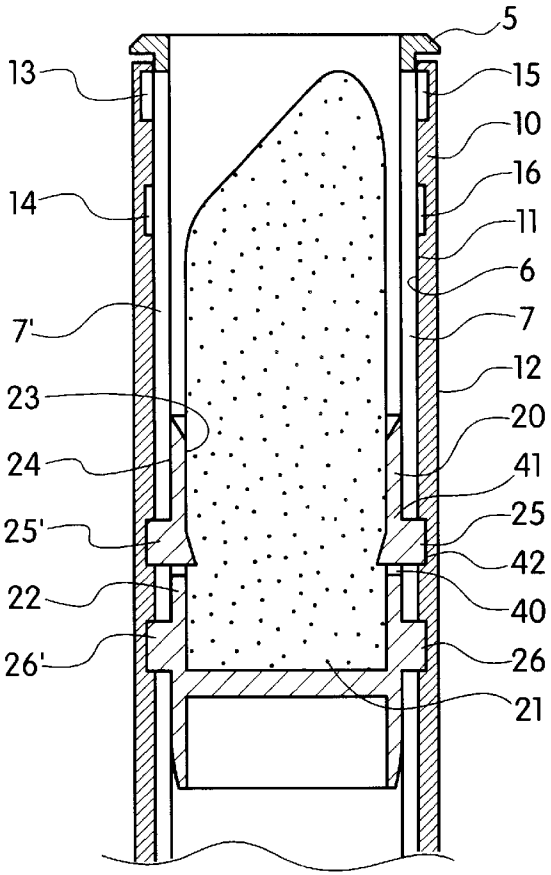
FIG. 4 is a partial cross-sectional view of the case of the present invention wherein the holder cup has a pivotable lug which has been advanced into the second closed position.
Figure 3:
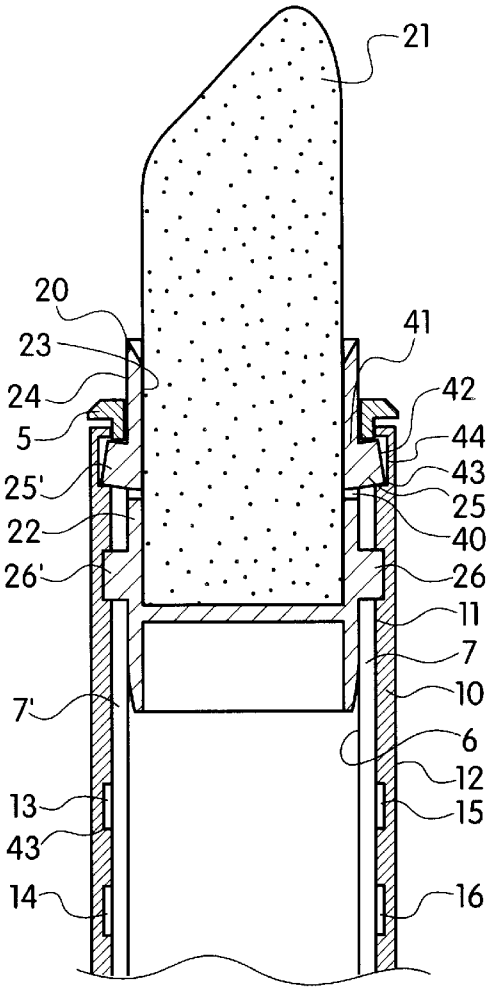
FIG. 3 is partial a cross-sectional view of the case of the present invention wherein the holder cup has a pivotable lug in the first open position.

FIGS. 3 and 4 show a further embodiment of the case of the present invention. As with the first embodiment of FIG. 1, the case of FIGS. 3 and 4 generally comprises a hollow inner sleeve 5 having a wall 6 and two longitudinal tracks 7 and 7' within the wall 6. The inner sleeve 5 has previously been described above with reference to FIGS. 1 and 2. An outer sleeve 10 is fitted about the inner sleeve 5 so as to be able to rotate with respect to the inner sleeve 5. The outer sleeve 10 has an inner wall 11, an outer wall 12, and four helical grooves 13, 14, 15, 16 along the inner wall 11.

A holder cup 20 for the stick product 21 is fitted into the inner sleeve 5. The holder cup 20 comprises a shell 22 having an inner surface 23 and an outer surface 24. A first set of lugs 25 and 25' and a second set of lugs 26 and 26' extend from the outer surface 24 of the holder cup 20. When placed within the inner sleeve 5, lugs 25 and 26 extend through longitudinal track 7, and lugs 25' and 26' extend through longitudinal track 7'. Each lug 25, 25', 26, and 26' engages its respective helical groove 13, 14, 15, and 16 of the outer sleeve 10.

With the embodiment of FIGS. 3 and 4, at least one lug of the holder cup 20 is pivotable. As shown in FIGS. 3 and 4, two lugs 25 and 25' are pivotable. It is, however, within the scope of the present invention to have one, two, three, or all four lugs pivotable. The pivotable lug is capable of occupying a first open position (see FIG. 3), or a second closed position in which the lug penetrates the stick product (see FIG. 4). To accomplish this, the shell 22 of the holder cup 20 is provided with an orifice 40, within which the lug is mounted via a flexible member 41. The flexible member 41 allows the lug 25 to pivot between the first or second position. The lug 25 is mounted so that in the first position the lug 25 is "open" and will not interfere with the stick product 21 as it is inserted into the holder cup 20 (see FIG. 3). The lug 25 is then pivoted to a second closed position through the interaction of a cam surface 42 on lug 25 and a cam 43 positioned within the case, which interaction occurs as the outer sleeve 10 is rotated with respect to the inner sleeve 5 so that the holder cup 20 is moved toward the retracted position within the case. Typically, the holder cup will be formed of a plastic material, and the flexible member 41 will be an extension of the shell 22 of the holder cup 20, as seen in FIGS. 3 and 4. Depending on the material chosen for the holder cup, the dimensions required of the flexible member 41 to enable the lug to pivot will vary, such dimensions being well known to one skilled in the art of plastic materials.

Preferably, cam 43 is the inner surface 44 of the helical groove. To form cam 43, the inner surface 44 of the helical grove is designed to gradually decrease in depth as the path of the groove is followed. In other words, the depth of the helical groove will be greatest when the holder cup is in the advanced position, and the depth of the helical groove will decrease as the holder cup is moved into the retracted position. This can clearly be seen in FIGS. 3 and 4, where helical groove 13 has a greater depth at the top of the case than at the middle of the case. This decrease in depth causes the cam 43 to push against the cam surface 42 of the pivotable lug 25 as the holder cup 20 is moved into the retracted position, thus causing the lug 25 to pivot about flexible member 41 such that the lug 25 penetrates and holds the stick product 21 in place within the holder cup 20.

The penetrating of the stick product by the lug acts to prevent the release of the product from the holder cup. The portion of the lug that penetrates the product is dimensioned so as to allow the lug to enter the product to a point sufficient to hold the product in place without fracturing or breaking the product. Typically, the penetrating portion of the lug will enter the product for a distance of about 1.0 millimeters to about 3.0 millimeters.

The benefits of the aforementioned embodiment of the present invention are threefold. First, the use of a first set and a second set of lugs provides the holder cup with stability as it travels between the advanced and retracted positions by significantly reducing the amount of skew that the holder cup experiences. Second, the incorporation of a pivoting lug which penetrates the product to hold the product in place allows the present holder cup to be used efficiently with stick products containing volatile components which evaporate over time to cause the stick to shrink. The penetrating lug assists in providing a frictional force sufficient to hold the stick product in place once it has shrunk and pulled away from the inner wall of the holder cup.

Finally, the action of the cam against the pivotable lug eliminates the need for lubrication of the case. When a traditional swivel case is assembled, the mechanism of the case is lubricated with an oil, such as lanolin, to provide a smooth function between the moving parts. The use of lubrication can cause compatibility problems with the stick product, interfere with case function if too much or too little is used, and also increases the cost of manufacture because an additional step is required. With the present case, the use of the cam and the pivotable lug eliminates the need for any such lubrication. This is because, when the holder cup is moved between the advanced and retracted positions, the friction between the cam surface of the lug and the cam of the outer sleeve provides for a smooth operation.

Common materials used in manufacturing stick product holder cups of the present invention include polyethylene, polypropylene, acetal, polycarbonate, polyvinylchloride, polyethylene-terephthalate, acrylonitrile-butadiene-styrene, styrene-acrylonitrile, styrene, and the like. The choice of materials for the holder cup will be guided initially by compatibility with the intended stick product and ease of manufacture for the material chosen.

In a preferred embodiment the holder cup is acetal. Acetal is a material that can easily be molded in a thickness which will impart a significant amount of flexibility and structural integrity to the flexible member. Also, acetal provides a high degree of chemical resistance to many products.

The present invention, depending on the material selected, can be formed by a number of known processes. For example, when the holder cup is formed of a plastic material, a proper method of manufacture is injection molding. The use of injection molding as the preferred method for manufacturing the present invention allows the lug, the flexible member, and the shell to be formed as one integral unit. This reduces the cost of manufacture by eliminating any assembly costs that may be associated with multiple part holder cups that accomplish the same result.

What is claimed is:

1. A case for a stick product which comprises:

an inner sleeve having a wall and two longitudinal tracks through the wall, each longitudinal track positioned approximately circumferentially opposite with respect to the other;

an outer sleeve fitted about the inner sleeve so as to be able to rotate with respect to the inner sleeve, said outer sleeve having an inner wall, an outer wall, and four helical grooves along the inner wall; and a holder cup fitted into the inner sleeve, said holder cup comprising:

a shell having an inner surface and an outer surface;

a first set of lugs and a second set of lugs positioned on the outer surface, wherein one lug from each set extends through the same longitudinal track, and each lug from each set engages one of the four helical grooves.

2. The case of claim 1 wherein each longitudinal track has a first upper lateral segment, a second upper lateral segment, a first lower lateral segment, and a second lower lateral segment.

3. The case of claim 1 wherein a stick product is placed within the holder cup.

4. The case of claim 3 wherein the stick product is chosen from the group consisting of lipsticks, deodorants, lip balms, make-up foundations, clear cosmetic sticks, anti-acne sticks, concealers, and sunscreen sticks.

5. The case of claim 1 wherein, in response to the relative rotation of the inner sleeve with respect to the outer sleeve and the corresponding interaction of at least one of the longitudinal slots, at least one of the helical grooves and at least one lug of the first and second sets of lugs, the holder cup is movable in an axial path between an advanced position proximal to a top end of the case and a retracted position proximal a bottom end of the case.

6. The case of claim 5 wherein at least one lug of the first and second set of lugs is pivotable from a first open position to a second closed position in which at least a portion of the at least one lug is adapted to penetrate the stick product.

7. The case of claim 6 wherein the pivotable lug is outwardly biased toward the first position and is provided with an outwardly directed cam surface, and the helical groove within which the pivotable lug engages decreases sufficiently in depth from an upper end toward a lower end of the outer sleeve to interact with the cam surface to pivot the lug into the second closed position when the holder cup is moved toward the retracted position by rotation of the outer sleeve with respect to the inner sleeve.

8. The case of claim 1 wherein the first set of lugs and the second set of lugs are aligned vertically with respect to each other.

9. The case of claim 1 wherein each lug of the first set of lugs is positioned on a horizontal axis and spaced approximately 180 degrees circumferentially from the other lug within the set.

10. The case of claim 1 wherein each lug of the second set of lugs is positioned on a horizontal axis and spaced approximately 180 degrees circumferentially from the other lug within the set.

11. A case for a stick product which comprises:

an inner sleeve having a wall and two longitudinal tracks through the wall, each longitudinal track positioned approximately circumferentially opposite with respect to the other;

an outer sleeve fitted about the inner sleeve so as to be able to rotate with respect to the inner sleeve, said outer sleeve having an inner wall, an outer wall, and four helical grooves along the inner wall; and a holder cup fitted into the inner sleeve and movable in an axial path between an advanced position proximal to a top end of the case and a retracted position proximal a bottom end of the case by the relative rotation of the inner sleeve and the outer sleeve, said holder cup comprising:

a shell having an inner surface and an outer surface;

a first set of lugs and a second set of lugs positioned on the outer surface, wherein one lug from each set extends through the same longitudinal track, and each lug from each set engages one of the four helical grooves; and wherein the pivotable lug is pivotable from a first open position to a second closed position.

12. The case of claim 11 wherein the longitudinal track has a first upper lateral segment, a second upper lateral segment, a first lower lateral segment, and a second lower lateral segment.

13. The case of claim 11 wherein the pivotable lug is outwardly biased toward the first open position and is provided with an outwardly directed cam surface, and the helical groove within which the pivotable lug engages decreases sufficiently in depth from an upper end toward a lower end of the outer sleeve to interact with the cam surface to pivot the lug into the second closed position when the holder cup is moved toward the retracted position in response to rotation of the outer sleeve with respect to the inner sleeve.

14. The case of claim 11 wherein a stick product is placed within the holder cup.

15. The case of claim 14 wherein the stick product is chosen from the group consisting of lipsticks, deodorants, lip balms, make-up foundations, clear cosmetic sticks, anti-acne sticks, concealers, and sunscreen sticks.

16. The case of claim 14 wherein at least a portion of the pivotable lug is adapted to penetrate the stick product when the lug is in the second closed position.

17. The case of claim 11 wherein the first set of lugs and the second set of lugs are aligned vertically with respect to each other.

18. The case of claim 11 wherein each lug of the first set of lugs is positioned on a horizontal axis and spaced approximately 180 degrees circumferentially from the other lug within the set.

19. The case of claim 11 wherein each lug of the second set of lugs is positioned on a horizontal axis and spaced approximately 180 degrees circumferentially from the other lug within the set.

* * * * *